US008681185B2

(12) United States Patent
Guncer

(10) Patent No.: US 8,681,185 B2
(45) Date of Patent: Mar. 25, 2014

(54) MULTI-PIXEL ADDRESSING METHOD FOR VIDEO DISPLAY DRIVERS

(75) Inventor: Selim E. Guncer, San Diego, CA (US)

(73) Assignee: Ostendo Technologies, Inc., Carlsbad, CA (US)

( * ) Notice: Subject to any disclaimer, the term of this patent is extended or adjusted under 35 U.S.C. 154(b) by 1024 days.

(21) Appl. No.: 12/717,365

(22) Filed: Mar. 4, 2010

(65) Prior Publication Data

US 2010/0225679 A1 Sep. 9, 2010

Related U.S. Application Data

(60) Provisional application No. 61/157,698, filed on Mar. 5, 2009.

(51) Int. Cl.
*G09G 5/10* (2006.01)

(52) U.S. Cl.
USPC ..... 345/690; 345/204

(58) Field of Classification Search
USPC ..... 345/204, 690; 348/254, 674; 704/204
See application file for complete search history.

(56) References Cited

U.S. PATENT DOCUMENTS

| | | | | |
|---|---|---|---|---|
| 5,452,024 | A | 9/1995 | Sampsell | |
| 5,508,716 | A | 4/1996 | Prince et al. | |
| 5,537,492 | A | 7/1996 | Nakajima et al. | |
| 5,696,524 | A * | 12/1997 | Hoshino et al. | 345/89 |
| 6,111,560 | A | 8/2000 | May | |
| 6,229,583 | B1 | 5/2001 | Yasunishi | |
| 6,477,279 | B2 | 11/2002 | Go | |
| 6,535,195 | B1 | 3/2003 | Nelson | |
| 6,850,219 | B2 | 2/2005 | Aoyama et al. | |
| 7,623,560 | B2 | 11/2009 | El-Ghoroury et al. | |
| 7,767,479 | B2 | 8/2010 | El-Ghoroury et al. | |
| 7,829,902 | B2 | 11/2010 | El-Ghoroury et al. | |

(Continued)

FOREIGN PATENT DOCUMENTS

| | | |
|---|---|---|
| CN | 1322442 | 11/2001 |
| CN | 1348301 | 5/2002 |

(Continued)

OTHER PUBLICATIONS

"Notice of Allowance Dated Nov. 28, 2012, Korean Patent Application No. 10-2011-7002953", (Nov. 28, 2012).

(Continued)

*Primary Examiner* — Tom Sheng
(74) *Attorney, Agent, or Firm* — Blakely Sokoloff Taylor & Zafman LLP

(57) ABSTRACT

A video display system is described which is formed by an array of pixels comprised of fast responding light elements, row select and column select switches and pixel data drivers, and a computation subsystem which generates the control signals for the select lines and the video data. The overall system reconstructs the intended image or video to be displayed through successively displaying subframes of images corresponding to orthogonal image basis function components of the original image acting on a grouping of pixels selected using multiple row and column lines. The resultant system is an architecture which enables one to implement certain video decompression techniques directly on the light elements, as opposed to implementing these techniques in digital processing, and can have a considerably reduced raw video data requirement than a system in which pixels are addressed individually, and enables higher dynamic range to be achieved with similar digital-analog-converter specifications. Embodiments with LED based displays are described herein.

4 Claims, 9 Drawing Sheets

| col4 | col3 | col2 | col1 | row4 | row3 | row2 | row1 | coefficient | macropixel pattern |
|---|---|---|---|---|---|---|---|---|---|
| 0 | 0 | 0 | 0 | 0 | 0 | 0 | 0 | not used | |
| 1 | 1 | 1 | 1 | 1 | 1 | 1 | 1 | 00 | |
| 0 | 0 | 1 | 1 | 1 | 1 | 1 | 1 | 01 | |
| 1 | 1 | 0 | 0 | 1 | 1 | 1 | 1 | 01* | |
| 1 | 0 | 0 | 1 | 1 | 1 | 1 | 1 | 02 | |
| 0 | 1 | 1 | 0 | 1 | 1 | 1 | 1 | 02* | |
| 1 | 1 | 1 | 1 | 0 | 0 | 1 | 1 | 10 | |
| 1 | 1 | 1 | 1 | 1 | 1 | 0 | 0 | 10* | |
| 1 | 1 | 1 | 1 | 1 | 0 | 0 | 1 | 20 | |
| 1 | 1 | 1 | 1 | 0 | 1 | 1 | 0 | 20* | |
| 0 | 1 | 0 | 1 | 1 | 1 | 1 | 1 | 03 | |
| 1 | 0 | 1 | 0 | 1 | 1 | 1 | 1 | 03* | |
| 1 | 1 | 1 | 1 | 0 | 1 | 0 | 1 | 30 | |
| 1 | 1 | 1 | 1 | 1 | 0 | 1 | 0 | 30* | |
| 0 0<br>1 1 | 1<br>0 | 1<br>0 | 1<br>0 | 0<br>1 | 0<br>1 | 1<br>0 | 1<br>0 | 11 | |
| 1 0<br>0 1 | 0<br>1 | 1<br>1 | 0 | 0 | 1 | 0 | 1<br>0 | 22 | |
| 1 0<br>0 1 | 0<br>1 | 1<br>1 | 0 | 0 | 0 | 1 | 0<br>1 | 21 | |
| 1 0<br>0 1 | 0<br>1 | 1<br>1 | 0 | 0 | 1 | 0 | 1<br>1 | 23 | |
| 1 0<br>0 1 | 1<br>0 | 1<br>0 | 1 | 0 | 0 | 1 | 0<br>1 | 33 | |

(56) References Cited

U.S. PATENT DOCUMENTS

| | | | | |
|---|---|---|---|---|
| 2002/0075217 | A1* | 6/2002 | Hoshino | 345/89 |
| 2005/0128172 | A1* | 6/2005 | Hoshino | 345/87 |
| 2006/0098879 | A1 | 5/2006 | Kim et al. | |
| 2007/0035706 | A1 | 2/2007 | Margulis | |
| 2007/0075923 | A1* | 4/2007 | Beuker et al. | 345/55 |
| 2008/0018624 | A1* | 1/2008 | Cernasov | 345/204 |
| 2008/0137990 | A1 | 6/2008 | Ward | |
| 2009/0086170 | A1 | 4/2009 | El-Ghoroury et al. | |
| 2009/0278998 | A1 | 11/2009 | El-Ghoroury et al. | |
| 2010/0003777 | A1 | 1/2010 | El-Ghoroury et al. | |
| 2010/0007804 | A1* | 1/2010 | Guncer | 348/790 |
| 2010/0066921 | A1 | 3/2010 | El-Ghoroury et al. | |
| 2010/0220042 | A1 | 9/2010 | El-Ghoroury et al. | |

FOREIGN PATENT DOCUMENTS

| | | |
|---|---|---|
| CN | 1666241 | 9/2005 |
| EP | 0577258 | 1/1994 |
| EP | 0720141 | 7/1996 |
| JP | 51-056118 | 5/1976 |
| JP | 2001-350454 | 12/2001 |
| JP | 2005-532588 | 10/2005 |
| WO | WO-2004/006219 | 1/2004 |

OTHER PUBLICATIONS

"Office Action Dated Aug. 20, 2012, European Patent Application No. 10710122.2" (Aug. 20, 2012).

Lueder, Ernst , "Liquid Crystal Displays, Addressing Schemes and Electro-Optical Effects", John Wiley & Sons Ltd., (2001), pp. 176-194.

Poynton, Charles , "Digital Video and HDTV Algorithms and Interfaces", *Morgan Kaufmann Publishers, an Imprint of Elsevier Science*, (2003), pp. 447-454.

Shirai, T. , et al., "RGB-LED Backlights for LCD-TVs with 0D, 1D, and 2D Adaptive Dimming", *2006 SID International Symposium, Society for Information Display*, SD 06 Digest, 44.4, (2006), pp. 1520-1523.

"International Search Report and Written Opinion of the International Searching Authority Dated Jun. 10, 2010", International Application No. PCT/US2010/026325.

"International Preliminary Examination Report of the International Preliminary Examination Authority Dated Apr. 14, 2011, International Application No. PCT/US2009/050175".

"International Search Report Report and Written Opinion of the International Searching Authority Dated Sep. 9, 2009", International Application No. PCT/US2009/050175.

"Office Action Dated May 31, 2012, Korean Patent Application No. 10-2011-7002953" (May 31, 2012).

"Office Action Dated Apr. 1, 2013, Korean Patent Application No. 10-2011-7023107", (Apr. 1, 2013).

"Office Action Dated Apr. 16, 2013; Japanese Patent Application No. 2011-517637", (Apr. 16, 2013).

"Office Action Dated Apr. 18, 2013; European Patent Application No. 10710122.2", (Apr. 18, 2013).

"Office Action Dated Mar. 4, 2013; European Patent Application No. 09790247.2", (Mar. 4, 2013).

"Office Action Dated Mar. 5, 2013, Japanese Patent Application No. 2011-553131", (Mar. 5, 2013), "Office Action Dated Apr. 22, 2013; Chinese Patent Application No. 200980134961.9", (Apr. 22, 2013).

Notice of Allowance Dated Oct. 1, 2013; Japanese Patent Application No. 2011-517637, (Oct. 1, 2013).

Office Action Dated Oct. 7, 2013; U.S. Appl. No. 12/499,560, (Oct. 7, 2013).

Office Action Dated Sep. 4, 2013; Chinese Patent Application No. 201080019853.X, (Sep. 4, 2013).

Office Action Dated Dec. 2, 2013; Korean Patent Application No. 10-2011-7023107, (Dec. 2, 2013).

Office Action Dated Nov. 25, 2013; European Patent Application No. 09790247.2, (Nov. 25, 2013).

* cited by examiner

Active Matrix TFT select transistors charging LCD pixel capacitors
(2 pixels shown)

Active Matrix TFT select transistors charging OLED pixel capacitors

| col4 | col3 | col2 | col1 | row4 | row3 | row2 | row1 | coefficient | macropixel pattern |
|---|---|---|---|---|---|---|---|---|---|
| 0 | 0 | 0 | 0 | 0 | 0 | 0 | 0 | not used | |
| 1 | 1 | 1 | 1 | 1 | 1 | 1 | 1 | 00 | |
| 0 | 0 | 1 | 1 | 1 | 1 | 1 | 1 | 01 | |
| 1 | 1 | 0 | 0 | 1 | 1 | 1 | 1 | 01* | |
| 1 | 0 | 0 | 1 | 1 | 1 | 1 | 1 | 02 | |
| 0 | 1 | 1 | 0 | 1 | 1 | 1 | 1 | 02* | |
| 1 | 1 | 1 | 1 | 0 | 0 | 1 | 1 | 10 | |
| 1 | 1 | 1 | 1 | 1 | 1 | 0 | 0 | 10* | |
| 1 | 1 | 1 | 1 | 1 | 0 | 0 | 1 | 20 | |
| 1 | 1 | 1 | 1 | 0 | 1 | 1 | 0 | 20* | |
| 0 | 1 | 0 | 1 | 1 | 1 | 1 | 1 | 03 | |
| 1 | 0 | 1 | 0 | 1 | 1 | 1 | 1 | 03* | |
| 1 | 1 | 1 | 1 | 0 | 1 | 0 | 1 | 30 | |
| 1 | 1 | 1 | 1 | 1 | 0 | 1 | 0 | 30* | |
| 0<br>1 | 0<br>1 | 1<br>0 | 1<br>0 | 0<br>1 | 0<br>1 | 1<br>0 | 1<br>0 | 11 | |
| 1<br>0 | 0<br>1 | 0<br>1 | 1<br>0 | 1<br>0 | 0<br>1 | 0<br>1 | 1<br>0 | 22 | |
| 1<br>0 | 0<br>1 | 0<br>1 | 1<br>0 | 1<br>0 | 1<br>0 | 0<br>1 | 0<br>1 | 21 | |
| 1<br>0 | 0<br>1 | 0<br>1 | 1<br>0 | 1<br>0 | 0<br>1 | 1<br>0 | 0<br>1 | 23 | |
| 1<br>0 | 0<br>1 | 1<br>0 | 0<br>1 | 1<br>0 | 1<br>0 | 0<br>1 | 0<br>1 | 33 | |

MULTI-PIXEL ADDRESSING METHOD FOR VIDEO DISPLAY DRIVERS

CROSS-REFERENCE TO RELATED APPLICATION

This application claims the benefit of U.S. Provisional Patent Application No. 61/157,698 filed Mar. 5, 2009.

BACKGROUND OF THE INVENTION

1. Field of the Invention

This invention relates to image and video displays, more particularly flat panel displays used as still image and/or video monitors, and methods of generating and driving image and video data onto such display devices.

2. Prior Art

Flat panel displays such as plasma, liquid crystal display (LCD), and light-emitting-diode (LED) displays generally use a pixel addressing scheme in which the pixels are addressed individually through column and row select signals. In general, for M by N pixels—or picture elements—arranged as M rows and N columns, we will have M row select lines and N data lines (see FIG. 1). For each frame, video data is loaded by applying a row-select signal to a particular row, then scanning the row column by column until the end is reached. In common LCD and LED based embodiments, the video data is written to each pixel in that row using a single or multiple data source demultiplexing a digital-analog converter output to the N columns. Each pixel is loaded with the required pixel voltage or pixel current information. Upon reaching the end of a row, the row-select signal is deselected and another row is selected in a progressive scan mode, or an interlaced scan mode. In a general active-matrix type LCD or LED embodiment, the video information is a voltage stored in a capacitor unique to the particular pixel (see FIG. 2). When the row and column signals de-select the pixel, the image information is retained on the capacitor. In contrast, in a passive-matrix type LCD embodiment, rows and columns are arranged as stripes of electrodes making up the top and bottom metal planes oriented in a perpendicular manner to each other (see FIG. 3). Single or multiple row and column lines are selected with the crossing point or points defining the pixels which have the instantaneous video information. In such a case, either the row or column signal will have a voltage applied which is proportional to the pixel information. In a light-emitting-diode display type embodiment in the passive matrix approach, the information is an instantaneous current passing through the pixel LED which results in the emission of light proportional to the applied current, or, in embodiments using fixed current sources, proportional to application time—which is also known as pulse width modulation. In all these display types mentioned, the amount of data required to drive the screen pixels is substantial. The total information conveyed to the display arrangement per video frame is then given as M×N×3× bit-width, where the factor 3 comes from the three basic colors constituting the image, i.e. red, green and blue, and the bit-width is determined from the maximum resolution of the pixel value. Most common pixel value resolution used for commercial display systems is 8 bits per color. For example, in a VGA resolution display, the total information needed to convey will be 640×400×3×8 equal to 6 Mbits per frame of image, which is refreshed at a certain frame refresh rate. The frame refresh rate can be 24, 30, 60, etc. frames per second (fps). The faster rate capability of the screen is generally used to eliminate motion blurring which occurs in LCD type displays, in which screen refresh rates of 120 or 240 fps implementations can be found in commercial devices. For a gray-scale image, the information content is less by a factor of three since only the luminance information is used.

Video and still images are generally converted to compressed forms for storage and transmission, such as MPEG2, MPEG4, JPEG2000 etc. formats and systems. Image compression methods are based on orthogonal function decomposition of the data, data redundancy, and certain sensitivity characteristics of the human eye to spatial and temporal features. Common image compression schemes involve the use of Direct Cosine Transform as in JPEG or motion JPEG, or Discrete Walsh Transform. In addition, video compression may involve skipping certain frames and using forward or backward frame estimation, skipping color information, or chroma subsampling in a luminance-chrominance (YCrCb) representation of the image etc. A video decoder is used to convert the spatially and temporally compressed image information to row and column pixel information in the color (RGB) representation to produce the image information, which will be for example at 6 Mbits per frame as in VGA resolution displays. However, from an information content point of view, much of this video information is actually spatially redundant as the image had originally been processed to a compressed form, or it has information content which the human eye is not sensitive to. All these techniques pertain to the display system's components in the software or digital processing domain, and the structure of the actual optical display comprised of M×N pixels is not affected by any of the techniques used for the video format, other than the number of pixels and frame rate.

Prior art in the field does not address image compression and decompression techniques directly. Data is generally made available on a pixel-by-pixel basis, with which the video system displays at a certain refresh rate. Image and/or video compression is generally applied to the transmission, storage and image reconditioning of data for the display (as in U.S. Pat. No. 6,477,279). Multiple line addressing in passive matrix displays is also an established technique (as in Lueder, E., "Liquid Crystal Displays—Addressing Schemes and Electro-Optical Effects", John Wiley & Sons 2001, pp. 176-194, or U.S. Pat. No. 6,111,560,). Time-domain Walsh function based orthogonal waveforms are applied to column and rows such that crossing points in the row and columns will generate shades of gray through amplitude modulation as desired. This is in contrast to employing two-dimensional orthogonal basis function expansions used in video and image compression.

BRIEF DESCRIPTION OF THE DRAWINGS

FIG. 3. depicts the pixel selection method employed in passive matrix LCD displays. There are M row select signals and N data signals. Signal timing determines which location will have an instantaneous voltage applied between the two electrodes, to which the liquid crystal molecules in between will react to.

Figure 1:
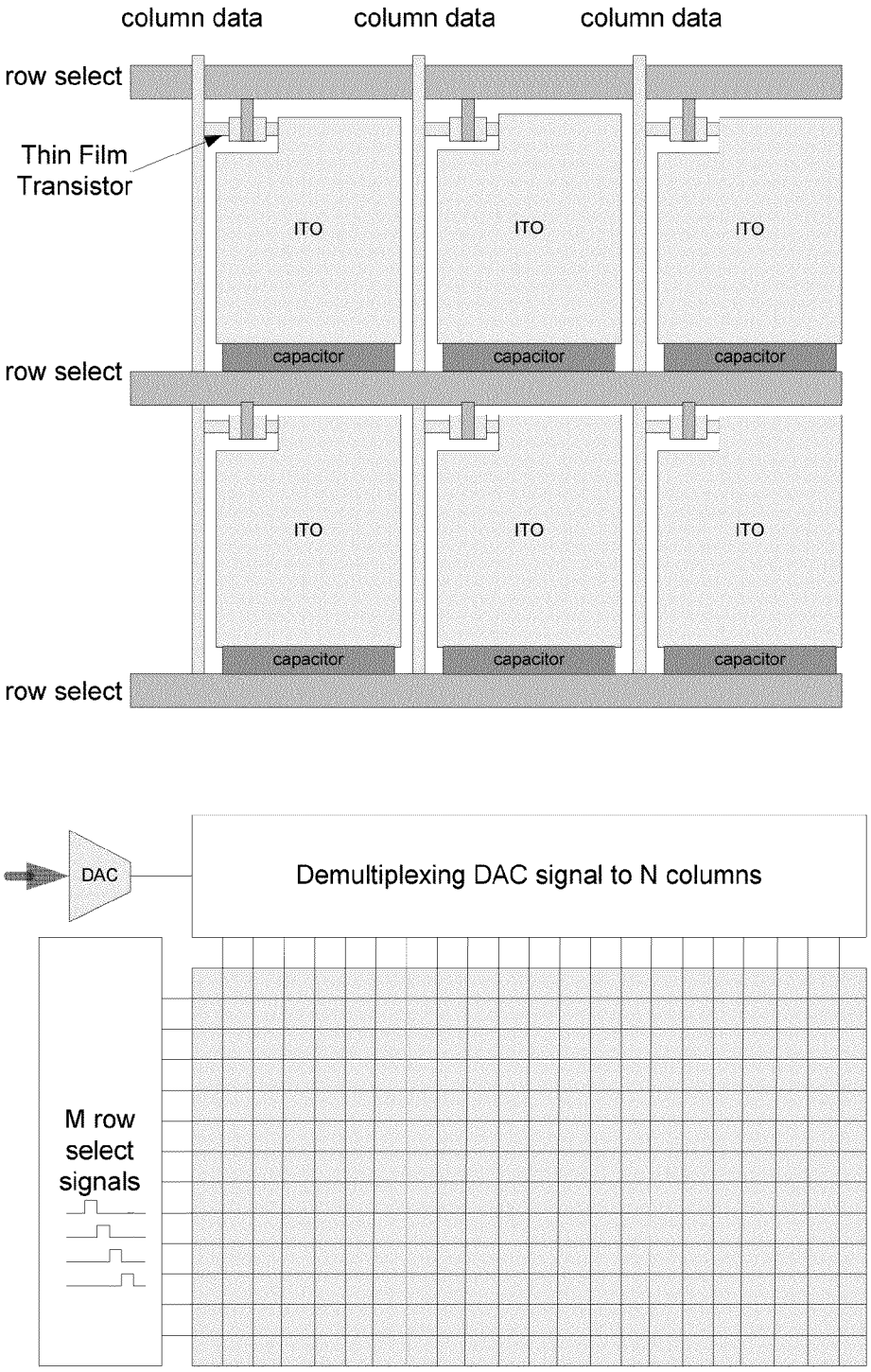
FIG. 1. depicts the pixel selection method used in active matrix flat panel displays, specifically an active matrix liquid crystal display. Each pixel is addressed through row and column select signals, with the video information applied through either one of the select signals. For an M×N pixel system, there are M row select signals, and N data lines. The data (video information) is generated by a Digital-Analog Converter, and the voltage is stored in a capacitor for each pixel. The voltage is applied to two parallel plates composed of a transparent electrode such as ITO (Indium Tungsten Oxide).
Figure 2:
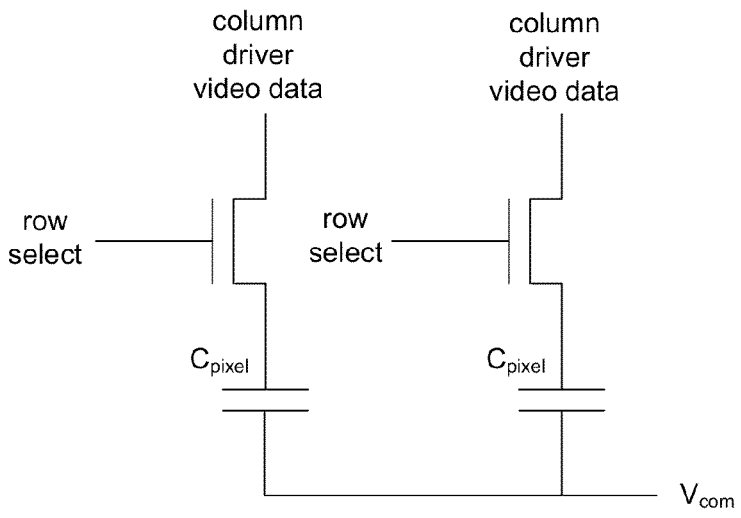
FIG. 2. shows typical active matrix pixel circuit topologies for LCD and LED based displays in which image information is retained through the use of a capacitor as a memory device when the pixel's row and column select switch signals are de-selected.
Figure 2:
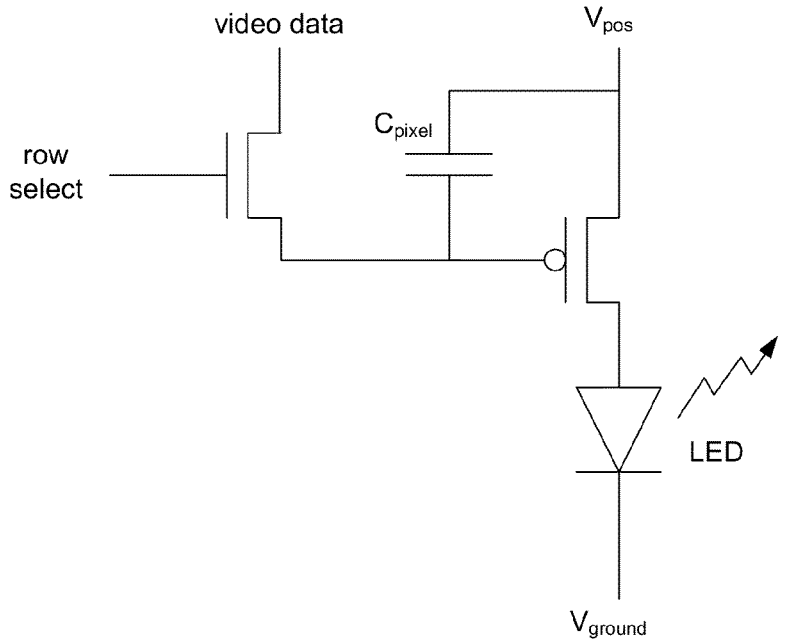
Figure 3:
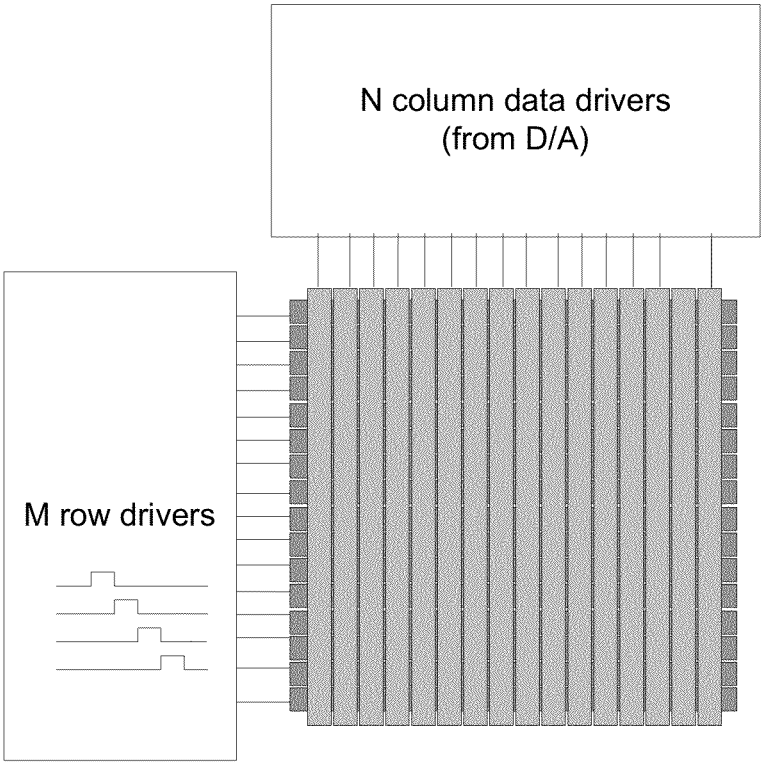

The present invention may have various modifications and alternative forms from the specific embodiments depicted in the drawings. These drawings do not limit the invention to the specific embodiments disclosed. The invention covers all modifications, improvements and alternative implementations which are claimed below.

DETAILED DESCRIPTION OF THE PREFERRED EMBODIMENTS

Figure 4:
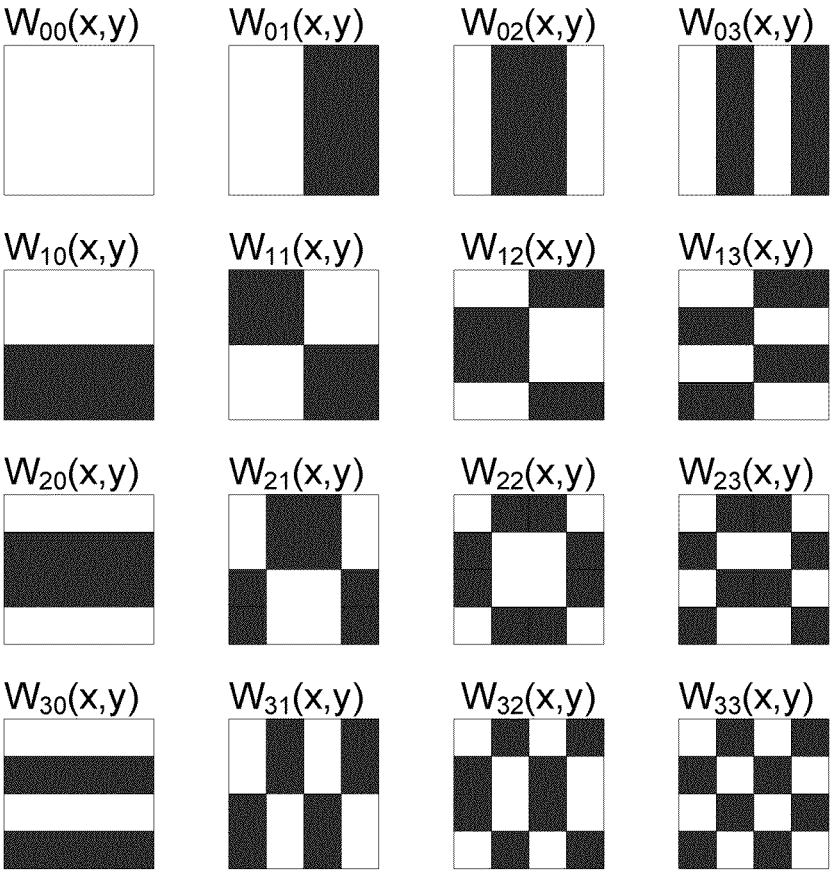
FIG. 4. shows the basis functions which need to be implemented as a masking pattern for a 4×4 pixel grouping.
Figure 5:
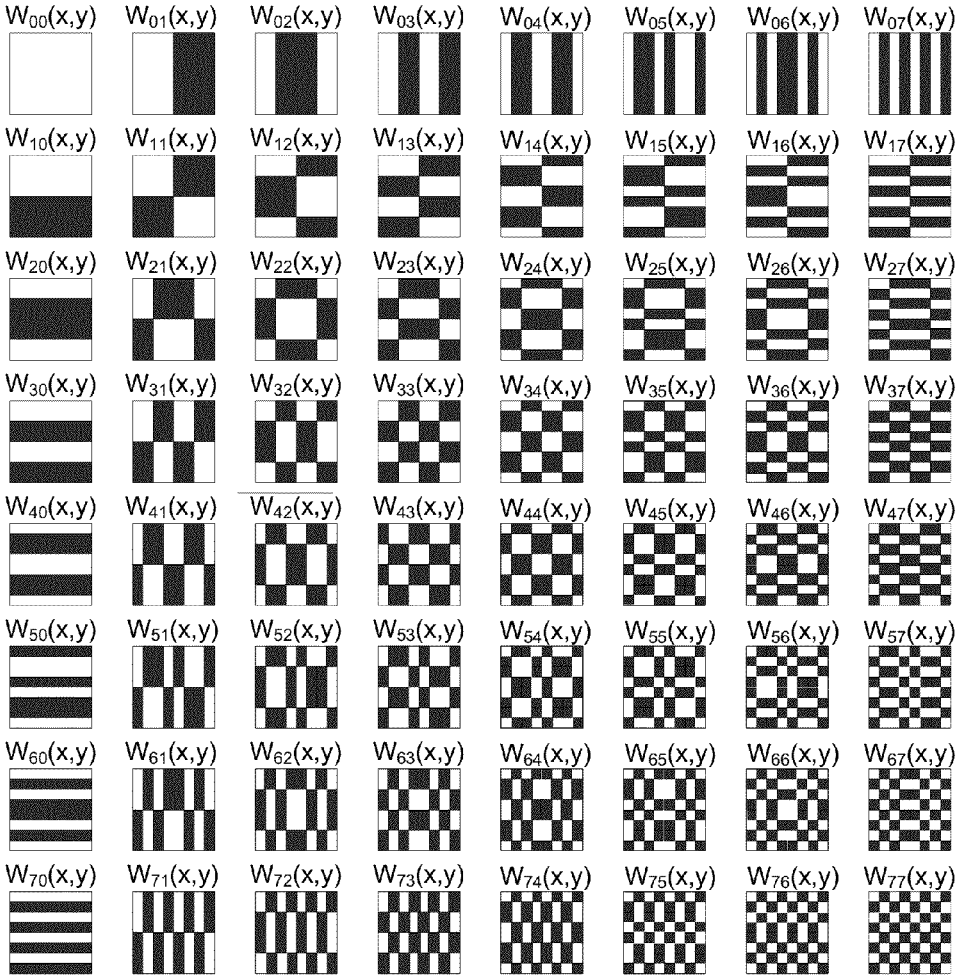
FIG. 5. shows the basis functions which need to be implemented as a masking pattern for a 8×8 pixel grouping.

The invention is a display method and system which constructs an image and/or video through successively displaying image components or summations of image components at a high frame rate. The image construction uses image compression to calculate orthogonal image coefficients, and drive these coefficients as video signals to pixel arrays in time domain through the use of time-dependent spatial masking of image information within a pixel array. The purpose of the invention is to enable content driven optimization of frame rate and/or video data rate for minimizing power consumption. In each frame, the source image to be driven is first grouped together to a certain size consisting of $n_x \times n_y$ pixels. For example, we can divide the image into rectangular groupings of 4×4 or 8×8 pixels, 4×1, 8×1, or any other arbitrary group size. 1×1 grouping case corresponds to conventional pixel-by-pixel driving, and offers no compression benefit. The grouping size is limited by the frame rate, which in turn is limited by the switching speed of the pixels and driver components described herein and the image compression ratio. Each image grouping, or macro-pixel as will be referred from here on, is then decomposed into components proportional to certain orthogonal image basis functions. These image functions are implemented through masking the row select and column data signals of the pixels so that the desired spatial profile of the orthogonal image basis functions are achieved. The image basis functions are shown in FIG. 4 for 4×4 and FIG. 5 for 8×8 pixel groupings. These particular basis functions shown are also commonly known as Walsh functions. Other basis functions, such as Direct Cosine Transform basis functions can also be used for basis function patterns with certain provisions. For 4×1 or 8×1 grouping, the basis functions are those in the first row of each figure. In FIGS. 4 and 5, for image compression purposes, the basis functions take on values of −1 and +1, denoted by the black and white areas. For image decompression, or construction of the image using light sources, a negative light value is not physically possible, and an implementation in which the dark areas denote a light intensity 0%, or masking of the transmission of light, and white areas denote a transmission of ideally 100% is disclosed. A method to take into account and correct the decompressed (or constructed) image when using a (0, +1) set for basis function values is described herein. For the first grouping of 4×4 pixels, there are 16 basis function patterns, while for the latter grouping of 8×8 pixels, there are 64 basis function patterns. Denote the basis functions as $w_{uv}(x,y)$ where u and v are the basis function indices and x, y are rectangular coordinates spanning the area of the pixel grouping dimensions. Denote $w^*_{uv}(x,y)$ as spatial functions derived from the basis functions $w_{uv}(x,y)$ such that the function values are in the (0,1) set. Such a transformation can be easily done through a simple arithmetic operation, as $w^*=(w+1)/2$. Denote $f^c(x,y)$ as the two dimensional image information for a color component. Here, the superscript c denotes the color red, green or blue. The method is identical for gray-scale images, in which case f(x,y) would be proportional to the luminance of the image. For an image decomposition based scheme, light emission or transmission is turned off in half the pixels for non-zero spatial components of the image, $D_{uv}w_{uv}(x,y)$, whose coefficients $D_{uv}$ are in general smaller than $D_{00}$, described in EQ. 1.

Any image can be decomposed into orthogonal components, whose coefficients are found by integrating the image data with the basis functions shown in FIG. 4 and FIG. 5. For a video pixel array, which is a spatially discrete function, this integration takes the form of a summation. Denote the coefficient of the image component related to the basis function $w_{uv}(x,y)$ as $D_{uv}$ where u and v are the basis function indices in two dimensions. Then, $D_{uv}$ are determined from:

$$D^c_{uv} = \sum_{x=0}^{n_x-1}\sum_{y=0}^{n_y-1} f^c(x, y) * w_{uv}(x, y) \quad \text{EQ. 1}$$

The invention is based on the inverse transform of EQ. 1, i.e. that an image f(x,y) can be constructed as a summation of image components $D_{uv}*w_{uv}(x,y)$.

$$f^c(x, y) = \sum_{u=0}^{n_x-1}\sum_{v=0}^{n_y-1} D^c_{uv} * w_{uv}(x, y) \quad \text{EQ. 2}$$

The summation of the image components is performed in time domain through successively displaying patterns corresponding to the basis functions $w_{uv}$ with a light strength proportional to coefficients $D_{uv}$ and a certain subframe duration $\tau_{sf}$. Further, we transform into a basis function set w* from w, as described below, such that the image components are positive for all x,y. The human eye would integrate the image patterns in time, and perceive a single image corresponding to f(x,y). If the pixel electronics have a capacitor to which the pixel image data is stored, it can also be used in integrating the image pattern along with the viewer. In this case, the image is updated with each pattern, and not rewritten. Since the capacitor voltage is not reset at each step, a smaller amount of charge needs to be added to the capacitor at each subframe—this will result in lowering the power consumption of the data drivers. In pulse-width-modulation (PWM) based implementations, the 'on' time of selected pixels conforming to a $w_{uv}$ pattern is common. In essence, a single PWM generator is used for the whole group of pixels.

In orthogonal function implementations used in conventional Discrete Walsh Transform compression techniques, the basis functions $w_{uv}(x,y)$ take on values of +1 or −1, thereby they can satisfy orthogonality properties, in which the integration over the macro-pixel region of the cross product of two different basis functions is zero. i.e.

$$\sum_{x=0}^{n_x-1}\sum_{y=0}^{n_y-1} w_{uv}(x, y) w_{u'v'}(x, y) = n_x n_y$$

for (u,v) equal to (u',v'), and zero when the indices do not match. In U.S. Patent Application Publication No. 2010/0007804, an image construction based video display system is described, which uses orthogonal Walsh function based the current application, an extension of these techniques are made for application to fine-arrays of pixels, with which individual row and column control are possible, and a spatial light modulator is therefore not necessary. When the basis functions are mapped to +1 or 0 instead of +1 or −1, as in U.S. Patent Application Publication No. 2010/0007804, this creates a non-zero integration value of the cross product of two different basis functions over the macro-pixel area. Such functions, because of their non-orthogonal nature, can not be used in deconstructing the image into components, hence the original orthogonal basis functions having values of +1 or −1 are used in determining image coefficients $D_{uv}$ using EQ. 1. In performing an image construction using EQ. 2 in which coefficients $D_{uv}$ are computed using orthogonal basis functions, each component of the image, given by the function $D_{uv}*w_{uv}$ will have both positive and negative values throughout the macro-pixel, for u,v components other than 0,0. When we restrict the image components to be non-negative, through the use of basis functions in the +1, 0 domain, we are introducing averaging artifacts. Displaying an image component $D_{uv}*w^*_{uv}(x,y)$ will create an average value of $0.5\times D_{uv}$ for u,v other than 0,0. The 0,0 image component $D_{00}*w^*_{00}(x,y)$ is equal to the sum of the image over the macro-pixel, and is effectively the image averaged out over the macro-pixel area.

$$D^c_{00} = \sum_{x=0}^{n_x-1}\sum_{y=0}^{n_y-1} f^c(x, y)$$

Since each image component having u,v indices other than 0,0 will now contribute ½th of the $D_{uv}$ value to the macro-pixel average, we should really be displaying the 0,0 image component with a strength equal to $$D^c_{00} - \frac{1}{2}\left(\sum_{u=0}^{n_x-1}\sum_{v=0}^{n_y-1} D^c_{uv}\right)$$

In general, $D_{00}$ is greater than or equal to the sum of the rest of the image components derived using the +1 and 0 mapping. Hence, subtracting out each of these non-zero integration components from $D_{00}$ will be greater than or equal to zero. Consider for example the $D_{01}$ component. Denote $w_{uv}$ as the original Walsh function having the values of +1 and −1. Using the new basis functions w*=(w+1)/2, substituting $w_{uv}$ which can take on values of 0 and 1 instead of −1 and +1, $w^*_{uv}$ will transform the image construction equation EQ. 2 to $$f^c(x, y) = 2\sum_{u=0}^{n_x-1}\sum_{v=0}^{n_y-1} D^c_{uv} * w^*_{uv}(x, y) - \sum_{u=0}^{n_x-1}\sum_{v=0}^{n_y-1} D^c_{uv} \quad \text{EQ. 3}$$

To reproduce the image correctly, the component value when the basis function is equal to all 1's ($w_{00}$) has to be corrected with the summation over all $D_{uv}$ except for the 00 component as in the second term of EQ. 3. Note that if a subset of basis functions are used as in lossy compression/construction, the summation will need to span only the $D_{uv}$ coefficients that are used. The updated $D_{00}$ coefficient is used in the image construction instead of the original value, since now the total sum of the average of the image components will equal the original $D_{00}$ value. $D_{00}$ may run negative in certain cases, which will cause artifacts. This can be treated in a lossy construction manner through hard limiting the number of dominant components to be displayed, or reducing the high frequency content in a more graceful manner, in essence spatially low pass filtering the image. Such artifacts can also be eliminated by reducing the pixel-grouping size for the region of interest. For example, transforming the 8×8 pixel region into four 4×4 block regions and implementing the algorithm at the reduced pixel group size level. Since the correction amount applied to the $D_{00}$ coefficient needs to be bounded by the $D_{00}$ value, having a smaller number of components in the image construction will result in this bound to satisfied with a higher spatial frequency bandwidth than a larger macro-pixel case.

The image coefficients $D_{uv}$ can have positive or negative values for all components having higher order than the 00 component. In implementing the display component, the value of $D_{uv}*w*_{uv}(x,y)$ can only be positive. In the case of 'negative' $D_{uv}$, the image component is generated using the absolute value of $D_{uv}$ and the inverse of the basis function pattern $w*_{uv}(x,y)$. The inverse pattern is defined by interchanging the 0 values with +1 values in the $w*_{uv}(x,y)$ pattern, i.e., inverting or reversing the switch pattern for that orthogonal basis function.

Figure 6:
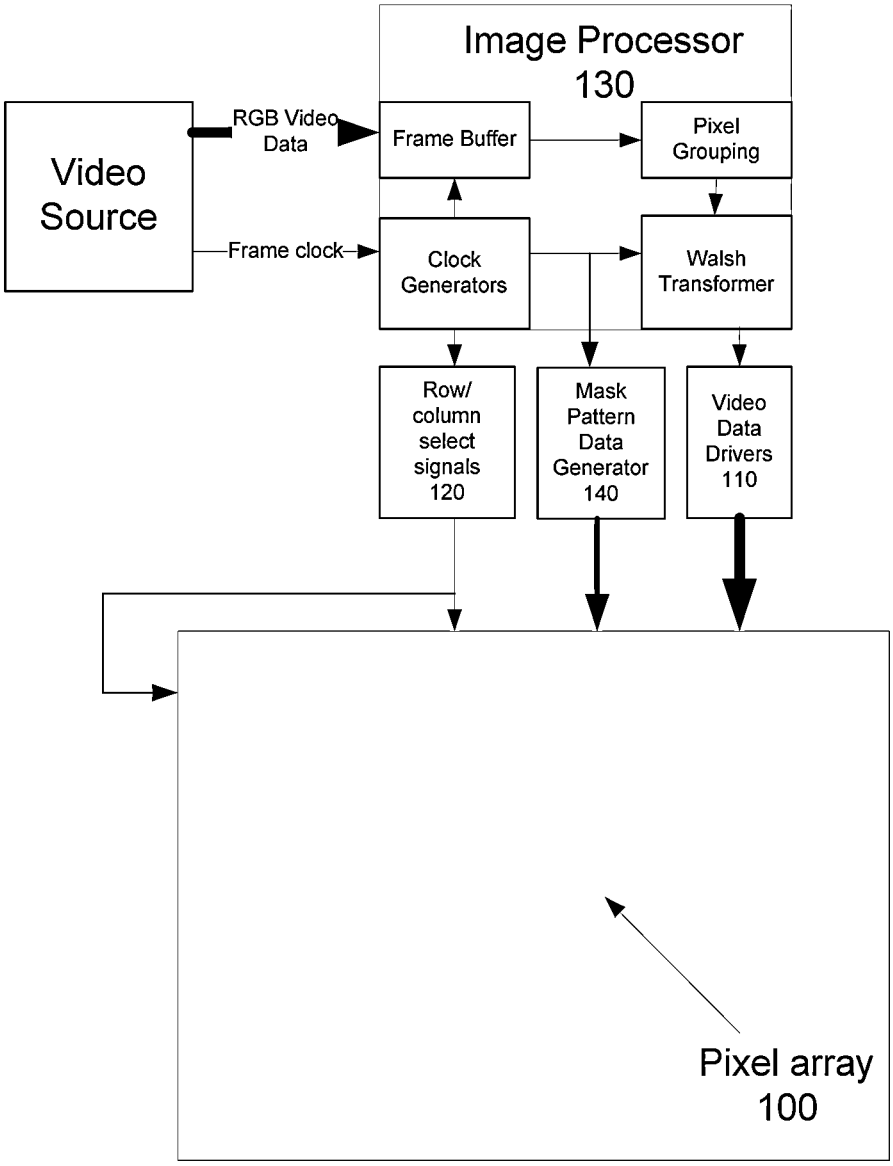
FIG. 6. shows the block diagram of the video display system employing a pixel array, row/column select circuitry operating on macro-pixels, masking pattern generation block, computation device for image processing which calculates discrete Walsh transform coefficients, and timing generator blocks.

A block diagram showing the whole system is in FIG. 6.

For each frame, the video image is constructed through

1. Dividing the video image and display of M×N pixels into P×Q macro-pixels, which are subarrays of pixels of dimension $n_x \times n_y$.
2. Calculating the image component strength $D_{uv}$ related to the image f(x,y) for each macro-pixel, and for each component if lossless compression method is sought, or for a subset of components which will be deemed satisfactory by the viewer, and for each color.
3. Set the uv index of the image component to be displayed—note that for each macro-pixel, this index need not be the same with other macro-pixels, and different macro-pixels can at any time can display different basis functions.
4. In the display, select the macro-pixel through scanning macro-pixel rows and macro-pixel columns. These are $n_x$ and $n_y$ size groupings of the pixel rows and columns.
5. Applying a spatial signal mask which generates a light intensity profile corresponding to $w*_{uv}(x,y)$ for the macro-pixel of interest. In an active-matrix type embodiment, this mask will select only the pixels which will be updated in the subframe.
6. Applying a voltage or current signal which will correspond to light emission proportional to $D_{uv}$ for each pixel selected to be in the on state in the macro-pixel. For color displays, three color light elements are used per pixel grouping. The light intensities of the red, green and blue sources are adjusted according to the calculated $D_{uv}$ for each color. The $D_{uv}$ coefficients can actually take positive or negative values. In the case of a negative coefficient, the light intensity is the absolute value of the coefficient, but in the reconstruction of the image, we use the inverse of the masking pattern (as applied in step 2 above).
7. Repeat for all macro-pixels.
8. Select the next uv component index to be treated and repeat from line 3.

Figure 7:
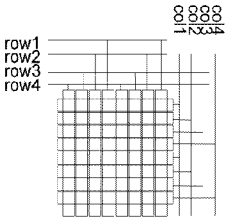
FIG. 7. shows row and column select table used to generate the masking patterns for 4×4 pixel grouping. Note that some high order patterns can not be generated in a single select step with this type of implementation. In these cases, the second pattern is generated with the inverse of the row and column select signals, with the column video data signal staying same. If the switching is fast enough, the two patterns can be squeezed in one subframe, if not, the second pattern can either use a subframe of its own, or be displayed in the next frame.
Figure 8:
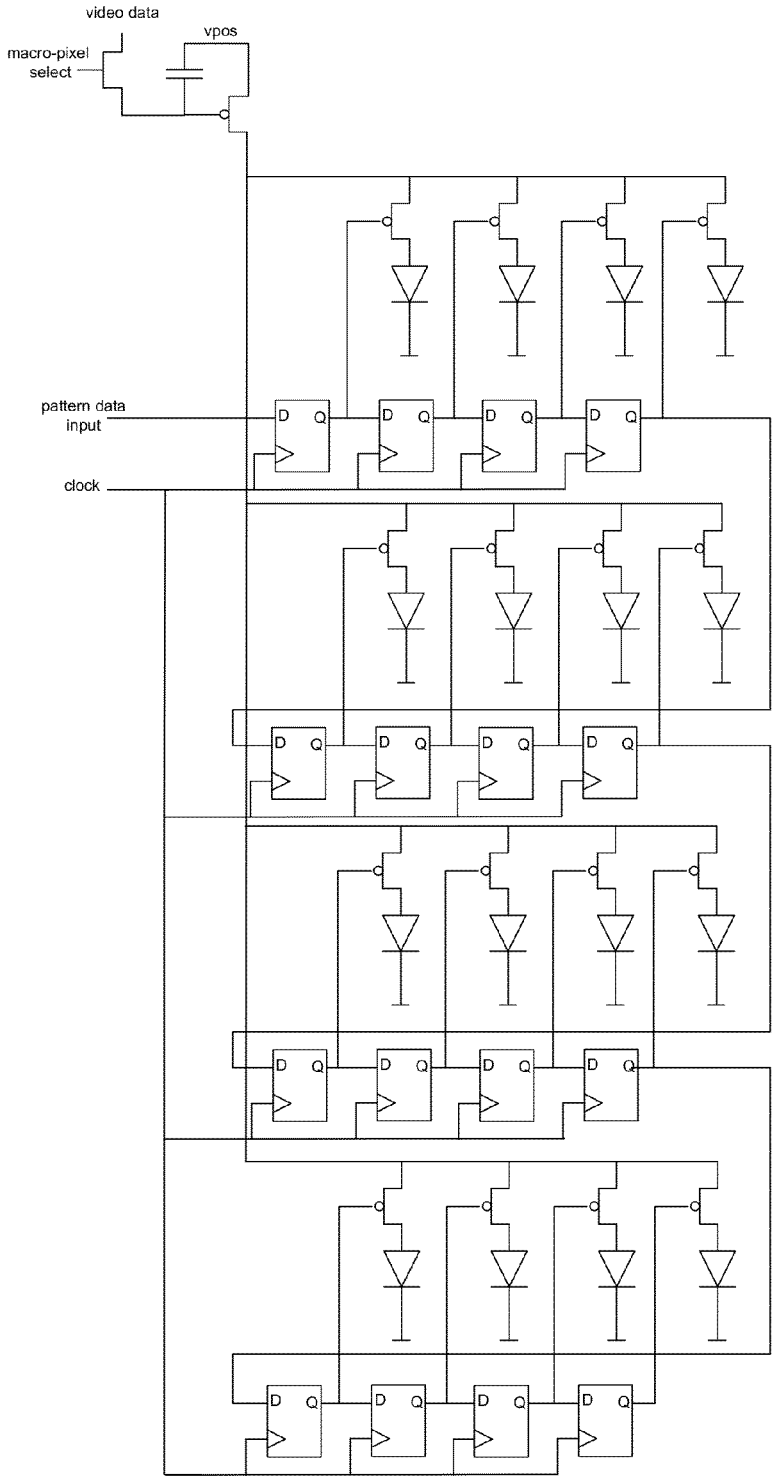
FIG. 8 shows an alternative switching structure for generating masking patterns for a 4×4 pixel grouping, based on a LED display architecture as shown in FIG. 2. The switch states are loaded through a serial data bus and stored in local registers. At every subframe, 16 bits are loaded serially corresponding to the on or off states of the pixels. A common video data signal is then applied to the 4×4 pixel grouping.

A subframe mask can be generated by selecting multiple row and columns spanning a macro-pixel. Assume a 4×4 pixel array forming the macro-pixel. The basis functions of FIG. 4 can be generated through the use of a digital function generator which turns on or off the select lines for each pixel in the macro-pixel. FIG. 7 shows the truth table for such a system. Note that some coefficients can be implemented in two steps for a 4×4 pixel array, and three or four steps for an 8×8 pixel array. FIG. 8 shows a register based implementation of a masking pattern generation function using serial data.

To arrive at a single frame of the intended image, each image component in a subframe is displayed successively. An observer's eye will integrate the displayed image components to visually perceive the intended image, which is the sum of all displayed image components. The $D_{uv}$ coefficients calculated in EQ. 1 assume equal subframe durations. The subframe duration can be made varying with the uv index, in which case the particular $D_{uv}$ will need to be normalized with the subframe time $\tau_{uv}$. Such a scheme may be used to relax the data driver's speed and precision requirements. The subframe image integration can also be partially performed in pixel structures which can retain the image data, as in active matrix pixels. In this case, instead of resetting the image information at each subframe, the corresponding signal stored in a capacitor is updated at each subframe. This is explained below.

A lossy compression based decomposition allows one to neglect higher spatial frequency component coefficients $D_{uv}$. These are generally components which have high order oblique spatial frequencies, which the human eye has reduced sensitivity to. Taking the example of 4×4 pixel grouping, which will have 16 image components with coefficients from $D_{00}$, $D_{01}$, $D_{02}$, $D_{03}$, $D_{10}$, $D_{11}$, etc. up to $D_{33}$, and transformed basis functions $w*_{00}$ through $w*_{33}$, and the inverses of these functions (except for the inverse of $w*_{00}$ which is a blank image), the original image will be exactly reconstructed if we use all 16 components, assuming the corrected $D_{00}$ coefficient remains non-negative. However, in a general moving video case, the oblique spatial components may be neglected to some extent. A display system which uses only horizontal and vertical image components can be satisfactory in some cases. To improve image accuracy, the dominant of the diagonal spatial frequency basis functions such as $w*_{11}$, $w*_{22}$, and or $w*_{33}$ having coefficients $D_{11}$, $D_{22}$ and/or $D_{33}$ can also be added. The oblique components such as $w*_{12}$, $w*_{13}$, $w*_{23}$ etc. may also be neglected if the picture quality is deemed satisfactory by applying a threshold below which we will neglect the component. In image and video compression techniques like JPEG and MPEG2 intra frame compression, the sequence of spatial frequency components are in a 'zig-zag' order, which allows for an 'EOB' (end-of-block) signal to denote that remaining coefficients in the sequence are negligible. The sequence goes as $w*_{00}$, $w*_{01}$, $w*_{10}$, $w*_{20}$, $w*_{11}$, $w*_{02}$, $w*_{03}$, $w*_{12}$, $w*_{21}$, $w*_{30}$, $w*_{40}$, etc. until an EOB is sent. Components before the EOB may also have negligible coefficient value. The video source coding can therefore have a variable sequence length, to which the display system will match. If none of the components are non-negligible, we would resort to lossless operation on the macro-pixel. Note also that different macro-pixels can have different levels of compression depending on the source video at the same time. Such a case can occur for example in a computer monitor, where during operation, regions of the screen may have stagnant images, but require a high accuracy such as a window showing a text and high resolution imagery, or portions having a fast moving image in which we need a high frame rate for motion compensation, but not necessarily need a lossless image reproduction scheme. By masking out different macro-pixel regions where we can skip certain image components, or updating the macro-pixel image less frequently, the image accuracy and power can be optimized. We can decide on which macro-pixel to run which accuracy mode by calculating the $D_{uv}$ coefficients and comparing them to the component coefficients in the earlier image frames. A fast moving image vs. slow moving or stagnant image, and an accurate image vs. a lossy compressed image can be differentiated thus. FIG. 8 shows how different macro-pixels on different regions of the screen can have different effective frame rates through the use of a smart controller.

In active matrix displays, in which the pixel circuitry may have a capacitor to hold the $D_{uv}$ coefficient value, we may partition the dominant components over several subframes. This is so that the capacitor charge does not change as much when we reset the value. For example, in transitioning from the $w*_{00}$ component to the $w*_{01}$ component, the capacitor voltage on half the pixels in a macro-pixel will be reset to zero, and the capacitor voltages on the remaining half of the pixels will be set to the $D_{01}$ coefficient value. This requires the column data drivers to charge and/or discharge up to the full capacitor voltage within a subframe duration, which costs power. Instead, the previous subframe data can be retained until the end of the frame, with the provision that it is normalized with the number of subframes the data will remain on the capacitor. To illustrate this, assume we have a lossless construction over 16 subframes, each subframe with equal duration. The time integrated voltage over the frame is given by EQ. 3. In this equation, the components $D_{uv}*w*_{uv}$ are assumed to be ON for one subframe duration, and the capacitors are reset to the next component voltage when the subframe duration ends. Instead, a portion of each previous component can be retained on the capacitor. The $w*_{00}$ component duration will then be 16 subframes, hence its value will be normalized by 16. Assume the second subframe is the $w*_{01}D_{01}$ component. This component will last for 15 subframes. This macropixel capacitors will be recharged such that the voltage at the second subframe is equivalent to $D_{00}w*_{00}/16+D_{01}w*_{01}/15$. The process repeats for each component, which will be normalized with the number of remaining subframes till the end of the frame. The last component to be displayed, $w*_{33}D_{33}$ will only be effective for one subframe, so it's value is not normalized. The net effect will be that at the end of the frame, we have the same integrated image information as EQ. 3.

Taking the example of a VGA resolution display operating at 30 frames per second, and a 4×4 pixel grouping to define the macro-pixels, the display device to satisfy VGA resolution employing this invention will use 1. 640×400 pixel array grouped as a 160×100 macro-pixel array for each color component.
2. A row and column select signal masking pattern generator which will generate the sixteen orthogonal basis patterns and the inverted patterns.
3. A computation device which calculates the corresponding $D_{uv}$ components for each color from a VGA resolution image at each frame.
4. Determining the desired effective frame rate by comparing key coefficients $D_{uv}$ with the previous frame's stored values.
5. Setting the row and column select pattern corresponding to the $D_{uv}$ coefficient to be displayed.
6. Applying a light signal proportional to $D_{uv}$, to all the selected pixels.

By using a pixel addressing mask pattern, the number of pixels which is addressed uniquely is reduced from 768000 (for three colors) by a factor of 16 down to 48000 (for three colors) for the VGA resolution display. There are 16000 macro-pixels in the display. The raw image data rate which the pixel drivers depends on the level of image compression desired. For a lossless image reconstruction, there are 16 image components per macro-pixel per color. Consider an 8 bit color system. If each component coefficient $D_{uv}$ is described with 8 bit accuracy, we would need a 184 Mbps data rate. This corresponds to 16 components×8 bits=128 bits per macro-pixel per color per frame. In reality, only the $D_{00}$ component needs to have the full 8 bit accuracy, while the higher order components can have less accuracy. The higher order components will in general be limited in amplitude by a factor of 0.5 to the lower order component. Hence, the first order coefficients $D_{01}$ and $D_{10}$ can be described with a 7 bit precision, the second order coefficient $D_{02}$, $D_{20}$, $D_{11}$ can be described with a 6 bit precision and so on. We would therefore not need more than 80 bits per macro-pixel per color per frame, which optimizes the data rate down to 120 Mbps. The video data driver precision need not satisfy the full 8-bit resolution throughout the frame, and can be made to have a dynamic resolution by turning off unnecessary components when not needed. Define arbitrarily three compression levels for clarification purposes—lossless compression, medium and high level compression. In actual implementation these definitions may have different forms based on the desired image quality. Assume that in a medium compression level, we cut off oblique spatial frequency components such as $w*_{12}D_{12}$, $w*_{13}D_{13}$, $w*_{23}D_{23}$ etc. but not $w*_{11}D_{11}$, $w*_{22}D_{22}$, $w*_{33}D_{33}$. Then we are working with 10 components in total. These components would require a total of 60 bits per macro-pixel per color per frame. The total data rate is reduced to 86 Mbps. Define the high compression level as an operation mode in which we neglect $D_{11}$, $D_{22}$, $D_{33}$. Then we would use 46 bits per macro-pixel per color per frame. The total data rate is then 66 Mbps. The row and column select pattern needs to be updated 16 times each frame for the lossless compression case, 10 times each frame for the medium level compression case, and 7 times each frame for the high level compression case. For 30 frames per second, displaying 7 subframes requires 210 patterns to be generated per second, or 4.7 msec per subframe. Using 10 components, we would need to generate 300 patterns per second, or 3.3 msec per subframe. For lossless image reproduction, a total of 16 subframes are needed, which equals 480 patterns per second, requiring 2 msec per subframe. These values provide a settling time bound for the data drivers.

In a particular embodiment of the invention, a LED based active-matrix display system is considered, though the invention is not so limited. The display system consists of:

1. A LED array of 640×400 red, green and blue light generating LEDs 100, totaling 768000 active elements.
2. A multitude of video digital-analog converter data drivers 110 which outputs the analog signals to the macro-pixels.
3. A row and column switch matrix 120 which scans the macro-pixel array, selecting the macro-pixel to be loaded with mask pattern and video data.
4. An image processing computation device 130 which determines the macro-pixel image coefficients using equation 1, and the timing control of the coefficients.
5. A mask pattern generation switch network 140 which turns on/off pixels within a macro-pixel to correspond to the orthogonal basis function to be displayed.

The pixels are grouped in 4×4 arrays, thus each red, green and blue LED defines a macro-pixel, thereby 48000 macro-pixels exist for three colors. The macro-pixels for different colors can be selected at the same time since the column video data is coming from different digital-analog converters. A fast enough digital-analog converter can service all pixels, or a larger number of digital-analog converters can be employed to relax the speed and driving requirements if necessary.

In the image processor 130, the image is divided into macro-pixel arrays for processing. For each macro-pixel, the image decomposition algorithm determines the coefficients corresponding to each orthogonal basis function for each color to be used. The decomposition coefficients $D_{uv}$, where u and v run from 0 through 3 are calculated. These coefficients are summations of 16 pixel values comprising the macro-pixel according to the corresponding masking patterns $w_{uv}$. The number of decomposition coefficients to be used can be selected from one to sixteen, in increasing resolution. The full set of sixteen coefficients is used when lossless reconstruction of the image is necessary. This mode is determined when all $D_{uv}$ coefficients are greater in magnitude from a threshold value. Portions of the display can also have different compression levels during operation, which the image processor can decide depending on the decomposition coefficient value it calculates. The row and column select block 120 scans and selects the macro-pixel to be operated on. Masking pattern generator 140 is a secondary switch network which drives the patterns related to the $D_{uv}$ coefficient to be displayed through a counter based logic, or a look-up table. The patterns are shown in FIGS. 4 and 5 for two different macro-pixel sizes. For 4×4 array comprising the macro-pixel, the sequence of patterns is $w^*_{00}$, $w^*_{01}$, $w^*_{02}$, $w^*_{03}$, $w^*_{10}$, $w^*_{20}$, $w^*_{30}$, $w^*_{11}$, $w^*_{22}$, $w^*_{33}$, $w^*_{12}$, $w^*_{21}$, $w^*_{13}$, $w^*_{31}$, $w^*_{23}$, and $w^*_{32}$. The particular order may be different depending on implementation and video statistics. For example, a zig-zag scan order is commonly used in image compression, in which case the order will be $w^*_{00}$, $w^*_{10}$, $w^*_{01}$, $w^*_{02}$, $w^*_{11}$, $w^*_{20}$, $w^*_{30}$, $w^*_{21}$, $w^*_{12}$, $w^*_{03}$, $w^*_{13}$, $w^*_{22}$, $w^*_{31}$, $w^*_{32}$, $w^*_{23}$, and $w^*_{33}$. The counter may reset or skip at any point if the decomposition coefficients are negligible for higher order terms, thereby reducing the total data rate.

Figure 9:
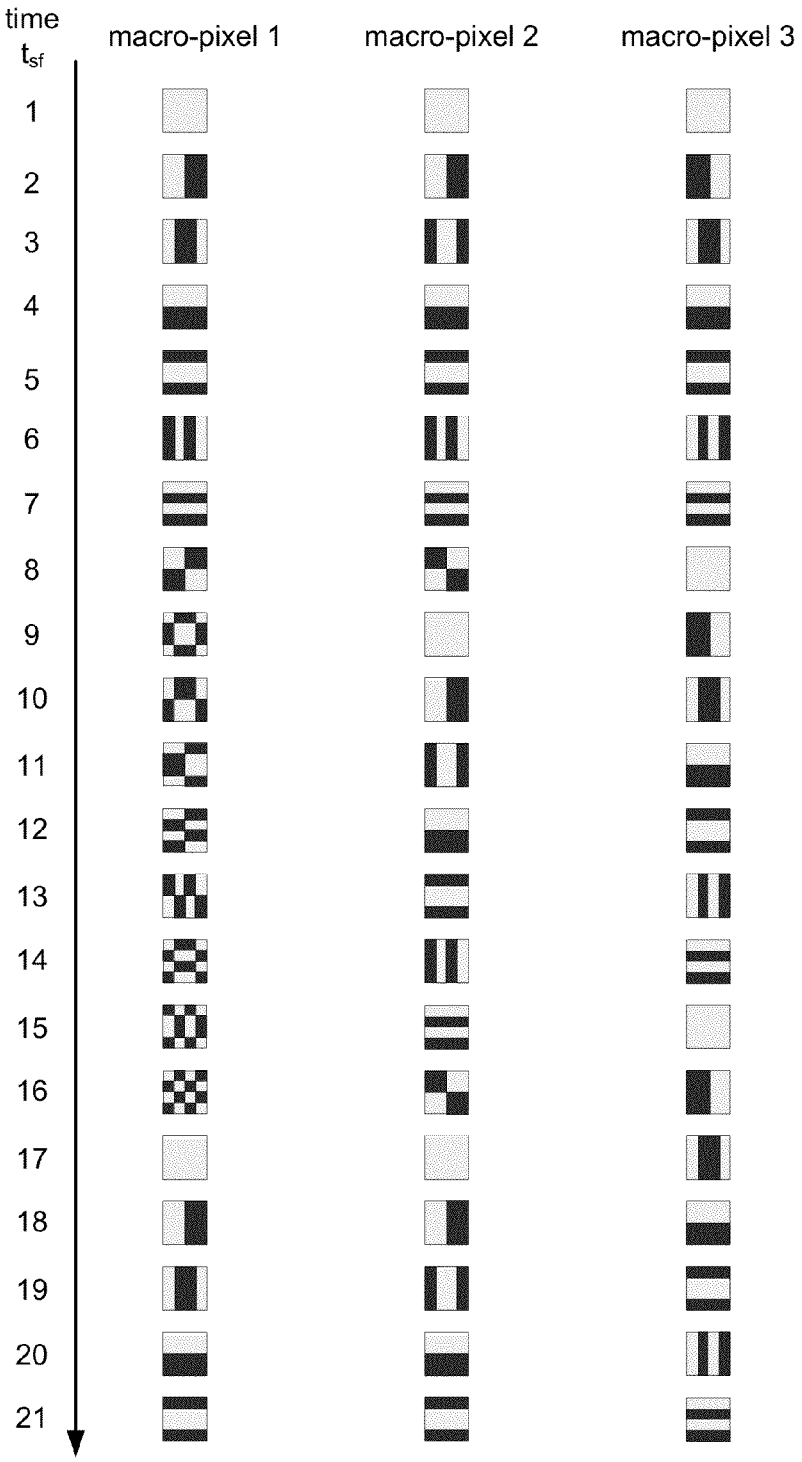
FIG. 9. shows example subframe patterns for three different macro-pixels exhibiting three different compression scenarios. The first macro-pixel is a lossless reconstruction of the image. The image is reset every 16 subframe durations. The second macro-pixel employs lossy image reconstruction such that terms image coefficients higher than $2^{nd}$ order for oblique spatial frequencies are neglected ($D_{21}$, $D_{12}$, $D_{13}$, $D_{31}$, $D_{22}$, etc.). The effective frame rate of this macro-pixel is twice the first one, as the image is reset every 8 subframe durations. The third macro-pixel employs a higher compression, and neglects all oblique spatial frequencies, exhibiting a higher effective frame rate than the other two. The order of coefficients need not be the same as each macro-pixel's pattern can be uniquely addressed, and also the phase of the pattern, depending on the $D_{uv}$ coefficient being positive or negative, can be different. The particular reconstruction to be decided upon is determined by examining the image coefficients of the macro-pixel, and possibly previous frames to determine how fast the content is moving across the screen and the amount of resolution required for satisfactory viewing.

The display is scanned at each frame starting with the $w^*_{00}D_{00}$ component of macro-pixels. The row and column select signal mask generated by 140 is all 1's in this case, meaning 4 rows and 4 columns are all selected. The necessary voltage signal is loaded to the video data memory, which can be a single capacitor for a macro-pixel array, and the macro-pixel scan proceeds to the next array. The subframe scan ends upon visiting all 48000 macro-pixels. The next subframe will load the $w^*_{01}D_{01}$ component to each macro-pixel. In this case, the mask generator 140 will generate the required signals for loading the pattern $w_{01}$ to the 4×4 pixel array. It can also load the inverse of the pattern if the $D_{uv}$ coefficient is negative. The signal masks can change for each macro-pixel in the scan, as there is no restriction as to which image coefficient is to be loaded during the scan. One macro-pixel can be loaded with a particular $D_{uv}$ with a masking pattern of $w_{uv}$, while the next macro-pixel in the scan can be loaded with a different component having a different masking pattern, since for one macro-pixel, a particular $D_{uv}$ term may be negligible and eliminated from displaying, while for another macro-pixel it may be non-negligible. Each macro-pixel can have a different effective frame rate. While the subframe update rate is common, since each frame may be composed of a different number of subframes. A macro-pixel can also have its frame rate changed by the image processor when the nature of the video content changes. This can happen as shown in FIG. 9, in which case a background image need not have a high effective frame rate, but can be represented at a higher accuracy by incorporating more $D_{uv}$ coefficients in the image construction, while a moving object can be represented by a smaller number of $D_{uv}$ coefficients, but updated at a higher frame rate.

A similar embodiment with an LCD based active-matrix display is also possible. In this case, since the pixel switching speeds may be considerably slower than that of a LED based display, subframe durations are longer. The maximum possible number of subframes that can be squeezed in a frame will be limited. In such a case, one may resort to driving modes in which a certain subset of $w^*_{uv}D_{uv}$ components are displayed in a frame, and the remaining components are displayed in an alternate frame such that the picture will have minimum loss of fidelity. In such a case the $D_{uv}$ coefficients will need to be normalized appropriately.

In certain LED based arrays (see U.S. Provisional Patent Application No. 60/975,772 filed Sep. 27, 2007), or MEMS based digital micromirror device (U.S. Pat. No. 5,452,024 filed Sep. 19, 1995), light elements can only be in ON or OFF states. The desired light value can be determined through pulse width modulation, or through bitplane modulation. In such an embodiment, pixels can be addressed as a group of macro-pixels, having a common ON time duration, but the data is AND'ed with the known basis function patterns of 1's and 0's. The number of subframes is again equal to the number of components that is used, or the maximum number of components pertaining to the macro-pixel size.

What is claimed is:

1. A method of displaying an image having M by N pixels, comprising;

selecting each of a plurality of macro-pixel groupings collectively forming the M by N pixel display;

generating patterns corresponding to on-off switch states of Walsh transform type orthogonal basis functions for each macro-pixel;

determining image coefficients for respective patterns;

for image coefficients which are negative, reversing the pattern from blocking to passing state ('0' to '1') and vice versa by inverting the pattern for the respective orthogonal basis functions and using the absolute value for the respective image coefficient in the following correction of the zero image coefficient;

cancelling the averaging artifact which arises from using patterns corresponding to non-orthogonal basis functions which multiply by 0 or +1 instead of −1 or +1 by correcting the zero image coefficient applicable to the entire macro-pixel by subtracting one half of the sum of the image coefficients applicable to all patterns before controlling pixel illumination;

controlling the pixel illumination within a macro-pixel using patterns responsive to an image coefficient for the respective pattern using the corrected zero image coefficient.

2. The method of claim 1 wherein when one half of the sum of the image coefficients are greater than the zero coefficient, then spatial frequency filtering to eliminate some non-zero coefficients and respective patterns employed to keep one half of the sum of the non-zero coefficients equal to or smaller than the zero coefficient.

3. The method of claim 1 wherein when one half of the sum of the image coefficients are greater than the zero coefficient, then reducing the number of pixels in the macro-pixel grouping to keep one half the sum of non-zero coefficients equal to or smaller than the zero coefficient.

4. The method of claim 1 wherein data defining the image is in digital form and lower order image coefficients have a greater bit precision than higher order image coefficients.

* * * * *